US009080829B1

(12) United States Patent
Cellini

(10) Patent No.: US 9,080,829 B1
(45) Date of Patent: Jul. 14, 2015

(54) STABILIZER BRAKE FOR FIREARM

(71) Applicant: Innovator Enterprises, Inc., San Antonio, TX (US)

(72) Inventor: Vito Cellini, San Antonio, TX (US)

(73) Assignee: Innovator Enterprises, Inc., San Antonio, TX (US)

( * ) Notice: Subject to any disclaimer, the term of this patent is extended or adjusted under 35 U.S.C. 154(b) by 97 days.

(21) Appl. No.: 13/714,710

(22) Filed: Dec. 14, 2012

Related U.S. Application Data

(60) Provisional application No. 61/570,583, filed on Dec. 14, 2011, provisional application No. 61/601,132, filed on Feb. 21, 2012.

(51) Int. Cl.

| | |
|---|---|
| ***F41A 21/00*** | (2006.01) |
| ***F41A 21/36*** | (2006.01) |
| ***F41A 21/30*** | (2006.01) |
| ***F41A 21/34*** | (2006.01) |

(52) U.S. Cl.
CPC ..... *F41A 21/36* (2013.01); *F41A 21/30* (2013.01); *F41A 21/34* (2013.01)

(58) Field of Classification Search
CPC ..... F41A 21/36; F41A 21/34
USPC ..... 42/1.06; 89/14.3, 14.4; 181/223
See application file for complete search history.

(56) References Cited

U.S. PATENT DOCUMENTS

| | | | | |
|---|---|---|---|---|
| 2,112,831 | A * | 4/1938 | Cutts, Jr. | 89/14.3 |
| 5,698,810 | A * | 12/1997 | Rose | 89/14.3 |
| 5,814,757 | A * | 9/1998 | Buss | 89/14.3 |
| 7,856,914 | B2 * | 12/2010 | Shults et al. | 89/14.4 |
| 8,307,946 | B1 * | 11/2012 | Johnston | 181/223 |
| 2012/0167749 | A1 * | 7/2012 | Young | 89/14.3 |
| 2013/0233162 | A1 * | 9/2013 | Schneider | 89/14.3 |

* cited by examiner

*Primary Examiner* — J. Woodrow Eldred
(74) *Attorney, Agent, or Firm* — Jackson Walker, LLP

(57) ABSTRACT

A muzzle brake and stabilizing device is provided for a firearm having a barrel, the barrel having a barrel axis, a muzzle, and a breech end. The muzzle brake comprises walls defining a first chamber adjacent the muzzle end of the barrel, the first chamber having a substantially closed end wall and side wall through openings. Walls defining a second chamber are proximate the first chamber, the second chamber has a substantially closed end wall and side wall through openings. Walls defining a third chamber are proximate the second chamber, the third chamber with a substantially open end and having side wall through openings. Walls defining an intermediate chamber are adapted to receive gases passing through the side walls of the first, second, and third chambers, the intermediate chamber with closed side walls and a substantially closed end wall. Walls defining a fourth chamber are proximate the end wall of the intermediate chamber, the fourth chamber having a substantially open end, and side wall closed end openings.

19 Claims, 8 Drawing Sheets

STABILIZER BRAKE FOR FIREARM

This patent application claims the benefit of and priority to U.S. Provisional Patent Application Ser. No. 61/570,583, filed Dec. 14, 2011; and U.S. Provisional Patent Application Ser. No. 61/601,132, filed Feb. 21, 2012.

FIELD OF THE INVENTION

Muzzle brakes or stabilizers; moreover, a multi-chambered muzzle brake having an intermediate chamber therein.

BACKGROUND OF THE INVENTION

Muzzle brakes function, in part, to redirect and control a burst of combustion gases that follow a projectile. In a conventional muzzle brake, these gases are directed at an upward angle to the muzzle, thereby creating a force counteracting the upward rise of the muzzle. In addition, muzzle brakes, besides redirecting gases, may slow the departure of combustion gases.

Typical muzzle brakes are ported expansion chambers, which have many openings that will allow communication between the muzzle and the outside environment.

However, a disadvantage of muzzle brakes is that they often substantially increase the total noise level. They also increase the flash from the hot gases that leave the barrel and in some cases reduce bullet velocity. Most firearms are loud to begin with and any increase in noise can be painful or potentially harmful to the shooter's hearing. This invention substantially reduces recoil, reduces muzzle rise, and redirects noise away from the shooter toward the target. In addition, it dramatically reduces flash and does not reduce bullet velocity. In some rifle models, this invention actually increases bullet velocity.

SUMMARY OF THE INVENTION

Applicant provides a muzzle brake and stabilizing device for a firearm, the muzzle brake being adapted to engage the muzzle of the barrel of the firearm and adapted to have multiple vented chambers substantially enclosed by an intermediate chamber and an open chamber having a multiplicity of closed ended openings.

A muzzle brake and stabilizing device is provided for a firearm having a barrel, the barrel having a barrel axis, a muzzle, and a breech end. The muzzle brake comprises walls defining a first chamber adjacent the muzzle end of the barrel, the first chamber having a substantially closed end wall and side wall through openings. Walls defining a second chamber are proximate the first chamber, the second chamber has a substantially closed end wall and side wall through openings. Walls defining a third chamber are proximate the second chamber, the third chamber with a substantially open end and having side wall through openings. Walls defining an intermediate chamber are adapted to receive gases passing through the side walls of the first, second, and third chambers, the intermediate chamber with closed side walls and a substantially closed end wall. Walls defining a fourth chamber are proximate the end wall of the intermediate chamber, the fourth chamber having a substantially open end, and side wall closed end openings. The chambers are axially aligned with one another with the bullet passing from the first through the last chamber and out the end of the muzzle brake, as it passes through the chamber closed end walls, though a bore axis opening in those end walls. Walls are adapted to engage the muzzle brake to the muzzle so as to place the axis of the chambers along the barrel axis.

Testing has found that the Applicant's multi-chambered sleeved muzzle brake to substantially reduce recoil, reduce muzzle rise, reduce flash, and redirect noise (away from the shooter towards the target) while having no adverse effect on bullet velocity.

DETAILED DESCRIPTION OF THE PREFERRED EMBODIMENT

FIGS. 1-6 illustrate Applicant's muzzle brake 10, which may be comprised in one embodiment of one or more machinee, threadably engageable members. Illustrated here is Applicant's muzzle brake 10 comprising an inner member 13 having an outer surface 13*a*, a threaded portion 13*b*, and an end cap 13*c*. Threaded muzzle engaging portion 13*d* is also provided on inner member 13. A sleeve 52 is provided having a threaded near end 53*a* and a threaded far end 53*b*. An end member 14 is provided having a threaded portion 14*a*.

Figure 1:
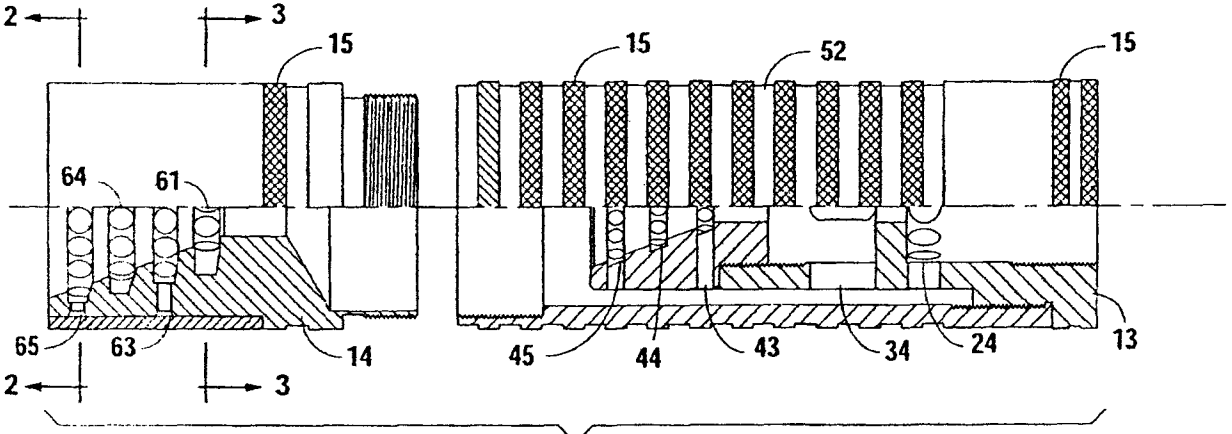
FIG. 1 is a partially cutaway side elevational view of Applicant's muzzle brake having a barrel axis BA.
Figure 2:
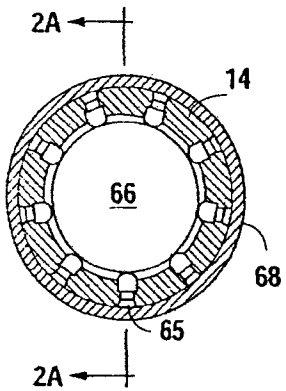
FIG. 2 is a cross-section through 2-2 of FIG. 1.
Figure 3:
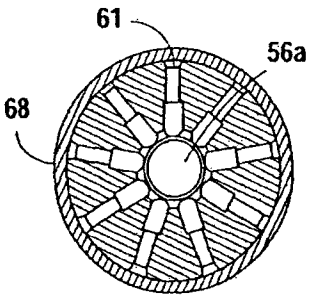
FIG. 3 is a cross-section through 3-3 of FIG. 1.
Figure 2A:
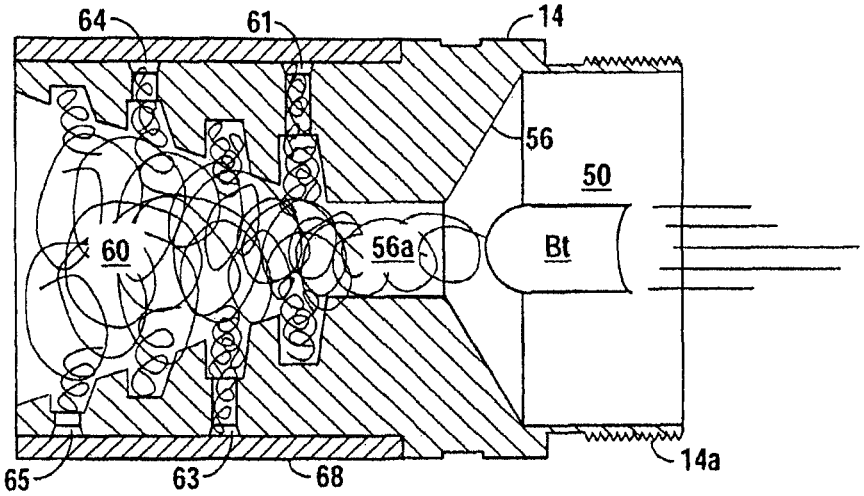
FIG. 2A is a detailed cross-sectional view of the fourth chamber along the bore axis of the muzzle brake.
Figure 4:
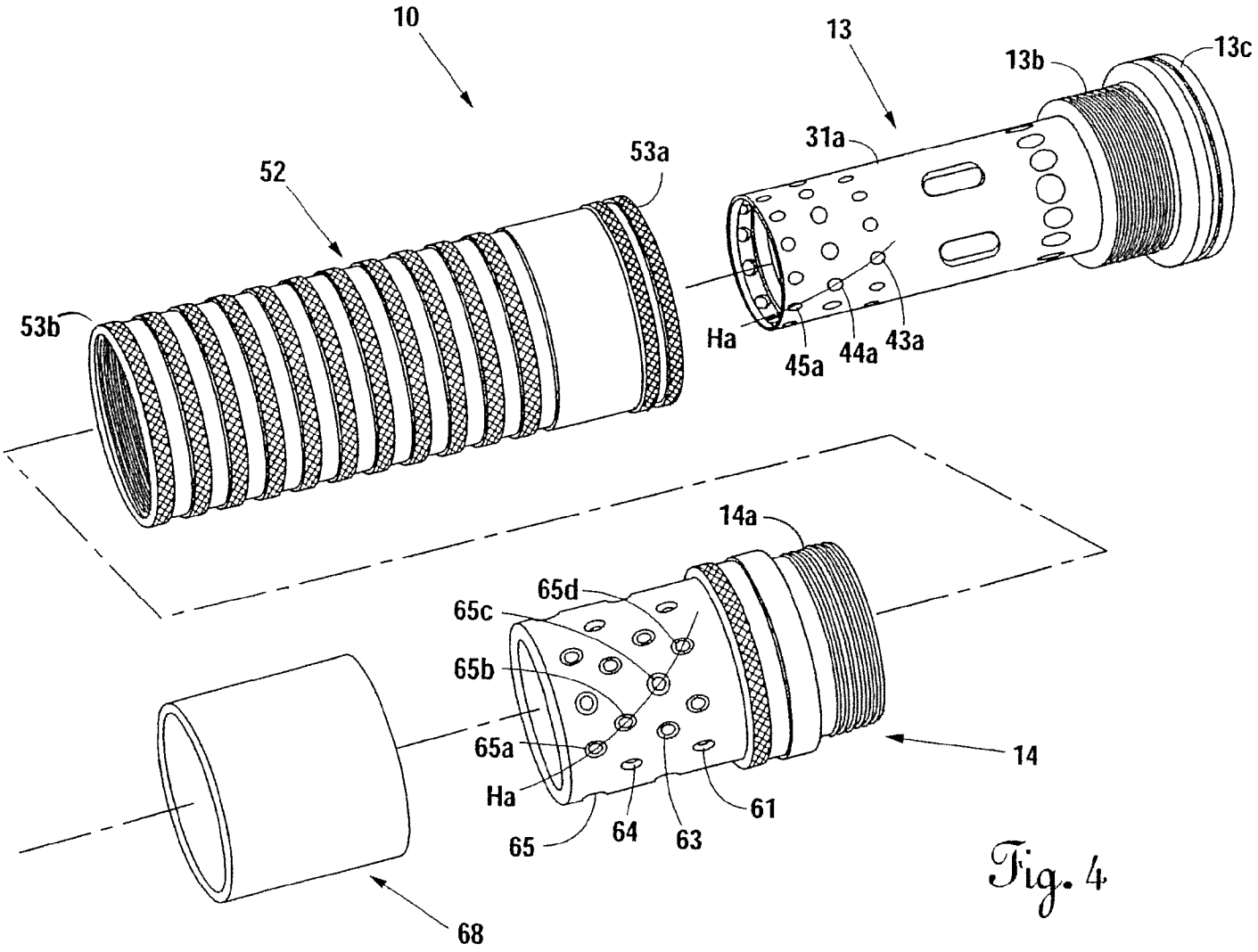
FIG. 4 is an exploded perspective view of the muzzle brake.
Figure 5:
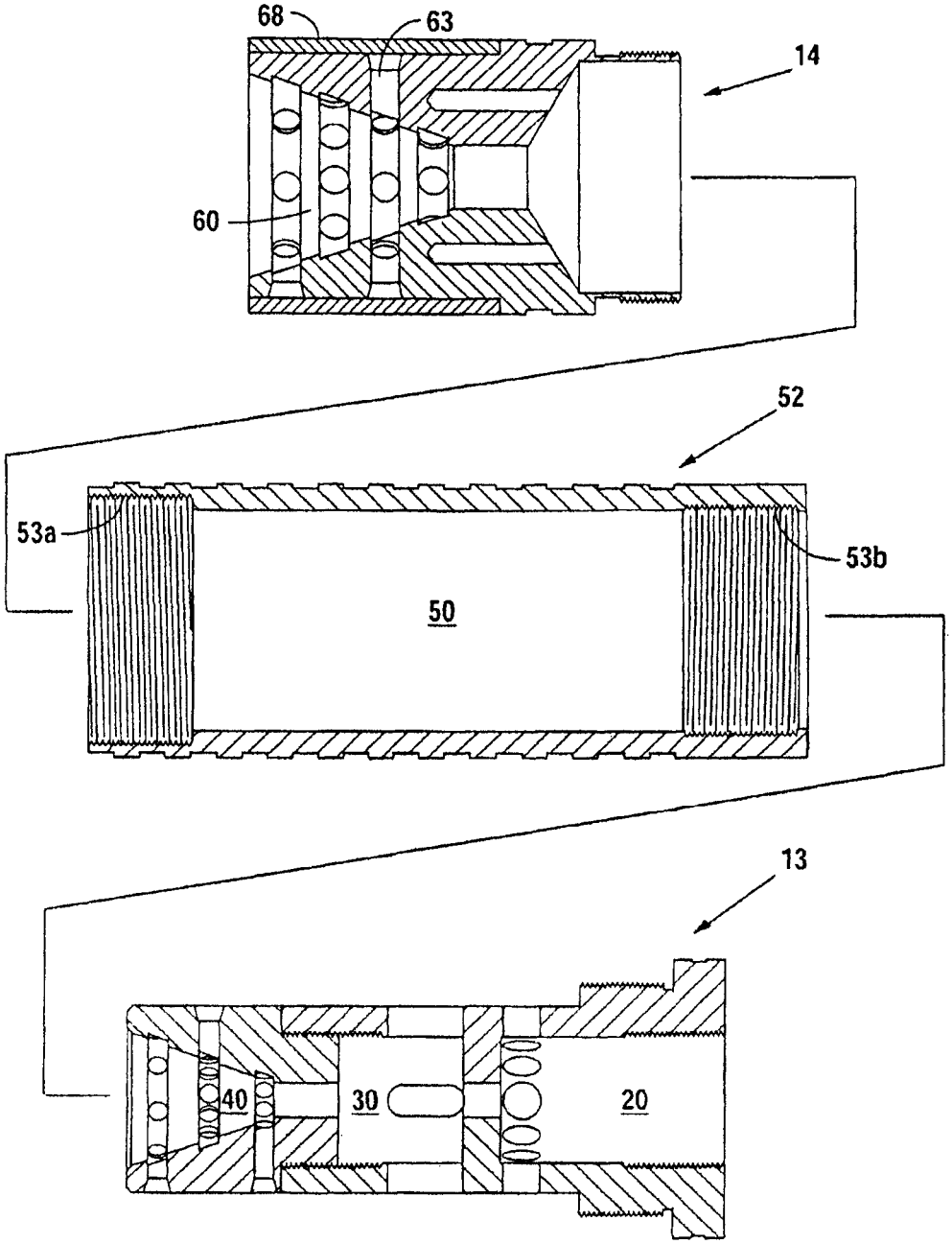
FIG. 5 is an exploded cross-sectional view of the muzzle brake illustrating the several components that it may include.
Figure 6:
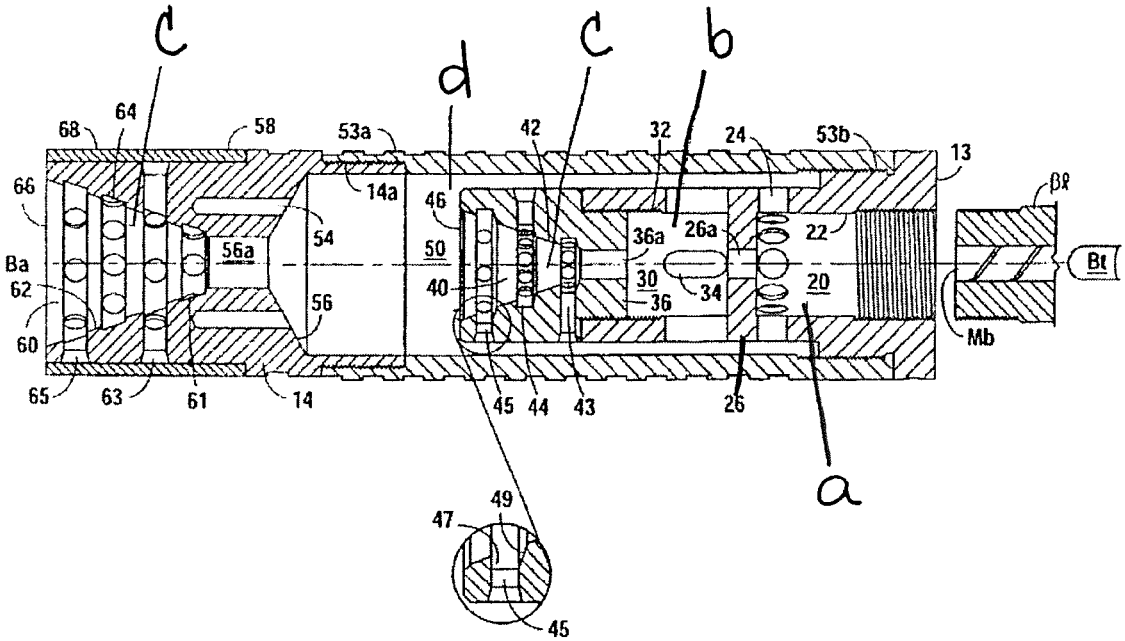
FIG. 6 is a side elevational cross-sectional view of the muzzle brake illustrating the manner that it engages the barrel of a weapon, such as a firearm.

As seen in the Figures, for example, FIGS. 5 and 6, inner member 13 lies substantially within the sleeve and is threadably engaged thereto. Inner member 13 comprises multiple chambers 20/30/40 separated by end walls 26*a*/36*a* through which a bullet Bt may pass through axial openings 26*a*/36*a*, with close tolerances. The bullet Bt passes through the muzzle brake 10 along the bore axis Ba thereof. Moreover, the outer walls of inner member 13 are seen to, in part, define an annulus between the inner walls of the sleeve 52. Moreover, it is seen that multiple chambers of the inner member may have side walls which may be vented into the annulus. A closed (meaning not vented to the exterior) intermediate chamber 50 is defined by the sleeve 52, threaded at one end to receive the inner member 13 and threaded at the other end to receive an end member 14. Intermediate chamber 50 is typically unvented (the gas cannot go out) except through the bore axis. End member 14 is seen to define a fourth chamber 60 with an open end 66 from which the bullet Bt passes out of the muzzle brake.

Applicant's muzzle brake 10 may be seen to comprise a multiplicity of primary chambers 20/30/40 vented to an intermediate closed chamber 50, closed (meaning the only venting of the intermediate chamber is through the bore axis or axial opening 56*a* where the bullet will pass with close tolerance to and through the fourth chamber 60). The inner member 13 is seen to comprise a multiplicity of primary chambers, that is to say, chambers that are vented into the intermediate chamber and through which the bullet will pass before it leaves the muzzle brake.

Illustrated in a preferred embodiment of Applicant's muzzle brake, a multiplicity of primary chambers, here, first chamber 20, second chamber 30, and third chamber 40. In a preferred embodiment of Applicant's muzzle brake, there is a single intermediate chamber closed to the outside except through the bore axis Ba with its axial openings. In a preferred embodiment, there is an end chamber, here, fourth chamber 60, which is open and from which bullet Bt leaves the muzzle brake. End chamber 60 comprises the removed end of the muzzle brake and first chamber 20 comprises the near end of the muzzle brake, which is threadably adapted to engage and threadably couple the outer surface of the end of the muzzle.

Typically, Applicant's muzzle brake is adapted to threadably engage a barrel B1 having a threaded male portion on the outer tip thereof (see FIG. 6), having a muzzle bore Mb with a rifling R therein. A bullet Bt will rotate responsive to the rifling as it moves through the muzzle bore along axis Ba and exits the muzzle and enters the muzzle brake 10.

Turning now to first chamber 20, it is seen to have side walls 22. Chamber side walls 22 are typically cylindrical and have through openings 24 therethrough. "Through openings" means channels open to both ends. Here, the through openings of first chamber 20 are adapted to carry projectile gases into the intermediate chamber 50. Axial or bore opening 26*a* is provided in end wall 26, so that the bullet Bt may pass therethrough along the bore axis Ba. End wall 26 is typically perpendicular to Ba, but may be angled, like end wall 56. While end walls 26/36/56 are referred to as "substantially closed," what that means in the context of these specifications, is that the only openings in the end walls are the openings configured and dimensioned to allow the bullet Bt to just pass therethrough. Second chamber 30 is seen to have chamber side walls 32, which are typically cylindrical, and through openings 34, which will vent gases from the second chamber into intermediate chamber 50.

Multiple wall through openings 24 of first chamber 20 are seen to lay adjacent and in a ring or radial line. Through openings may be any suitable number or in the range of four to ten. In a preferred embodiment, it is seen that through openings 34 of second chamber 30 are spaced apart. They may be any suitable number, but in one embodiment, number two to four. They may be round, oval or any other suitable shape. In one embodiment, there are four and they are spaced at twelve o'clock, three o'clock, six o'clock, and nine o'clock, with respect to a clock face laying perpendicular to the barrel, with twelve o'clock being straight up. Typically a single row of through openings 24/34 are provided, but there may be more than one.

End wall 36 is seen to have axial opening 36*a*. Passing through axial opening 36*a*, the bullet reaches third chamber 40. Turning now to third chamber 40, it is seen that side walls 42 are, unlike the previous two chambers, generally conical with third chamber 40 having an open end 46. Moreover, as in a preferred embodiment, the previous chambers 20/30 may have a single row of through openings 24/34, third chamber 40 typically has a multiplicity of countersunk openings 43/44/45 provided in the conically shaped chamber side walls. Moreover, and with reference to FIG. 4, it may be observed that individual holes 43*a*/44*a*/45*a* may be strategically placed along a hole axis Ha, which hole axis is aligned with the rifle grooves R. That is to say, hole axis Ha transects bore axis Ba in side view at the same angles that the rifling of the muzzle does.

Turning now to countersunk grooves and the detail illustration of FIG. 6, it is seen that the conical side walls of chamber 40 are countersunk and that interference walls 47 project at an angle that it at least partially intersects with bore axis Ba. In a preferred embodiment, interference walls 47 (there being one for each groove) will interfere with the passage of projectile gases as those gases pass along a line generally consistent with the bore axis so as to escape the muzzle brake at the removed end thereof. Interference walls 47 are configured, in a preferred embodiment to trend substantially perpendicular to the bore axis, so as to receive some of the molecules of the expanding explosive generally forward directed projectile gas molecules thereupon. So aligned for receipt of such collisions, momentum imparted to the interference walls will be in a direction the bullet is traveling, which is a direction generally opposed to the recoil of the weapon. Thus, the recoil is dampened, especially with a light weapon. Opposite interference walls 47 are partition walls 49, which act to deflect gas molecules and other particles that strike them, some deflected particles and molecules of which may strike other interference walls 47 especially those "downstream" along the muzzle brake.

Recoil damping is provided also by end walls 26/36 to the extent they are struck by molecules of expanding projectile gases in the first chamber 20 and second chamber 30. Likewise, referring to intermediate chamber 50, it is seen to have substantially closed end walls 56 adapted to receive expanding gas molecules at a high velocity thereupon, and again which are walls which are in one embodiment at least partially angled with respect to the bore axis and will thus impart a counteractive force to the coil force. In another embodiment, closed walls 56 are about perpendicular to Ba.

Intermediate chamber 50 is seen to receive gases as set forth above from the primary chambers 20/30/40, through the side walls of the first two and, through the side walls of chamber 40 and the open end 46 of chamber 40. Sleeve 52 is threaded at both ends in a multiple member embodiment of Applicant's muzzle brake to receive inner member 13 at a near end and end member 14 at a removed end. Inner member 13 may be made of one or more members coupled together as seen, for example, with walls defining third chamber 40 and also end wall 36 of second chamber 30 threadably coupled to walls defining chamber 20 and end walls defining second chamber 30.

Walls defining intermediate chamber 50 may include the end wall 56, which is substantially closed, having an axial bore opening 56*a* therethrough for the bullet to pass. End wall 56 may be slanted as seen in FIG. 6 or approximately perpendicular to Ba. One or more closed ended openings 54 may be provided in the wall as seen, for example, in FIG. 6, to help further absorb energy received by expanding projectile gases and other gases in the intermediate chamber. Intermediate chamber 50 may have an annulus portion 50*a* and an end portion 50*b*.

It is seen that the bullet passes into and through fourth chamber 60, which has chamber side walls 62 that are substantially conical. A multiplicity of closed ended openings 61/63/64/65 are seen closed ended openings, closed to the exterior of chamber 60, which has open end 66 open to the environment. Closed ended openings 61/63/64/65 are terminated at sleeve 68. Closed ended openings 61/63/64/65 may be countersunk in rows, but the rows may be staggered one with respect to the other, as the rows of openings 43/44/45 are to provide a hole axis Ha that is aligned with the rifle R of the muzzle. Moreover, the countersunk rows of openings 61/63/64/65 may have interference walls 47, structurally and functionally like those walls of chamber 40.

Through openings 34 are typically three or more in number. If there are three, they are typically spaced at about 120° apart. Four are spaced at about 90° apart; five, six, seven are typically spaced equally about a 360° circle.

In an alternate embodiment, the third chamber does not have through openings, and the fourth chamber does not have closed ended openings.

Seen without any side wall openings and with the walls and openings constructed as set forth herein, Applicant's muzzle brake 10 generates very little flame and almost all of the flame that is emitted by the muzzle brake is directed forward out fourth chamber 60 along Ba with only a very limited spread. This is especially important for night vision work where the shooter is wearing night vision goggles.

While Applicant's device is a muzzle brake, it may more broadly be considered a stabilizer. That is to say, it stabilizes the weapon to which it is attached. There is both less recoil and less muzzle climb. While not being limited by theory, it is believed that the primary and intermediate chambers as set forth above, slows down the propulsion of the projectile gases by absorbing energy within the muzzle brake, but which energy absorption is at least partially kinetic energy directed opposite the direction of recoil.

FIGS. 7-10 illustrate an alternate preferred embodiment of Applicant's muzzle brake or stabilizer 100. Muzzle stabilizer 100 is seen to include a cylindrical elongated outer member 102 into which fits a cylindrical, elongated, but shorter, inner member 104, such as by threadable engagement. Inner member 104 may have an inner member chamber plug 106 for threadable receipt into the removed end thereof.

Outer member 102 has an outer surface 108, a removed end 110, and a near end 112. Outer member 102 has an inner surface 114, which is cylindrical and includes a ribbed portion 116 and a threaded portion 118, the threaded portion 118 adjacent the near end of the inner member and adapted to engage the inner member as seen, for example, in FIG. 8.

Turning back to FIG. 8 and the detail illustrated on FIG. 8, it is seen that the inner surface 114 has a portion which is ribbed, the ribbed portion including a multiplicity of upstanding ribs 116*a*, ribs separated from adjacent ribs by bays 116*b*. The ribs are aligned transverse or perpendicular to the bore axis Ba and may have any suitable dimensions, for example, in one embodiment, of about 1/16" height and 1/16" spacing.

Ribs function to intercept and turbulate sound waves, small gas driven particles, and energy vibrations as well as gas exiting the barrel both ahead of and behind bullet Bt as it passes out of muzzle bore MB and through muzzle stabilizer 100. Ribs tend to reduce recoil.

Figure 9:
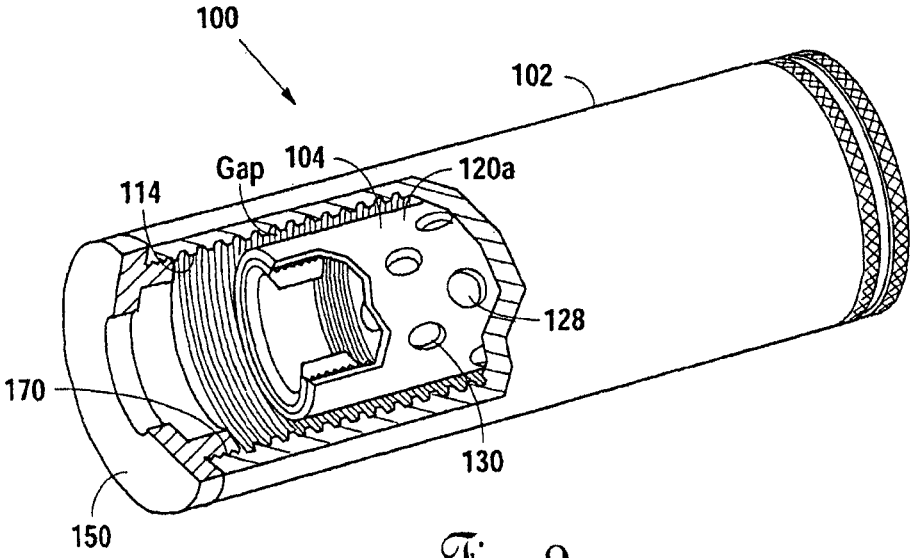

Inner member 104 is cylindrical and may have external walls 120, portion 120*a* of which are stepped down, having a diameter, for example, D102*a*. Outer member 102 has an inner diameter D102. The inner diameter of the outer member is larger than the outer diameter of stepped down portion 102*a*, such that there is a gap Gap as seen in FIG. 9 between stepped down portion 102*a* and inner surface 114 of outer member 102. Gap terminates before end walls defining removed end 110 of outer member 102. That is to say, the length of the inner member is shorter than the length of the outer member.

Stepped portion 120*a* of outer walls of inner member 104 communicate with the inner surface 135 of inner member 104 through a multiplicity of aligned rows 122/124/126/128/130, the rows being rows of holes. Holes 122*a*/122*b*/122*c*/122*d* define aligned row 122. Holes 124*a*/124*b*/124*c* define aligned row 124. Holes 126*a*/126*b*/126*c*/126*d* define aligned row 126. Holes 128*a*/128*b*/128*c* define row 128. Holes 130*a*/130*b*/130*c*/130*d* define row 130. The rows are aligned in a plane that is perpendicular or transverse to bore axis Ba as seen, for example, in FIG. 8. The holes of adjacent rows are staggered. The holes provide communication between the inner surface 135 and external walls stepped down portion 120*a*. Large holes may be provided for larger caliber firearms. The arrangement of holes as illustrated allows gases to exit the chambers more efficiently. More or less holes and/or rows may be used.

Threaded portion 132 of external walls 120 provide threaded communication between the inner member and the outer member, outer member with threaded walls 118 coupling to threaded walls 122, so as to maintain the inner and outer member in axial alignment with the Gap as illustrated. Shoulder 134 of inner member is dimensioned to abut near end of outer member 102.

Turning now to the interior of inner member 104, it is seen to be configured to define a first chamber 136 and a second chamber 138, the two chambers separated by dividing wall 140, which has a bore opening 142 therethrough. Moreover, first chamber 136 contains a multiplicity of aligned rows, here rows 122/124. Second chamber 138 contains a multiplicity of aligned rows, here rows 126/128/130. The chambers are cylindrical and defined by cylindrical inner walls or inner surface 135, and muzzle end walls Mew as well as end surface 140*a* of dividing wall 140. Thus, first chamber is, except for bore openings closed at the removed ends, cylindrical with a multiplicity of aligned rows of holes opening into Gap. Second chamber 138 is similar in that the end walls are opened only to allow the bullet to pass through, therefore having bore openings therein, and end surfaces 106*a*/104*b* lay in a plane generally perpendicular to the bore axis (see example, FIG. 8).

Inner chamber plug 106 may be threaded into inner member 104 through the use of threaded portion 148 on the inner surface of the removed end of the inner member. Inner member near end contains threaded portion 146 for threadable receipt onto the threaded end of the muzzle M as seen in FIG. 10, for example.

Figure 7:
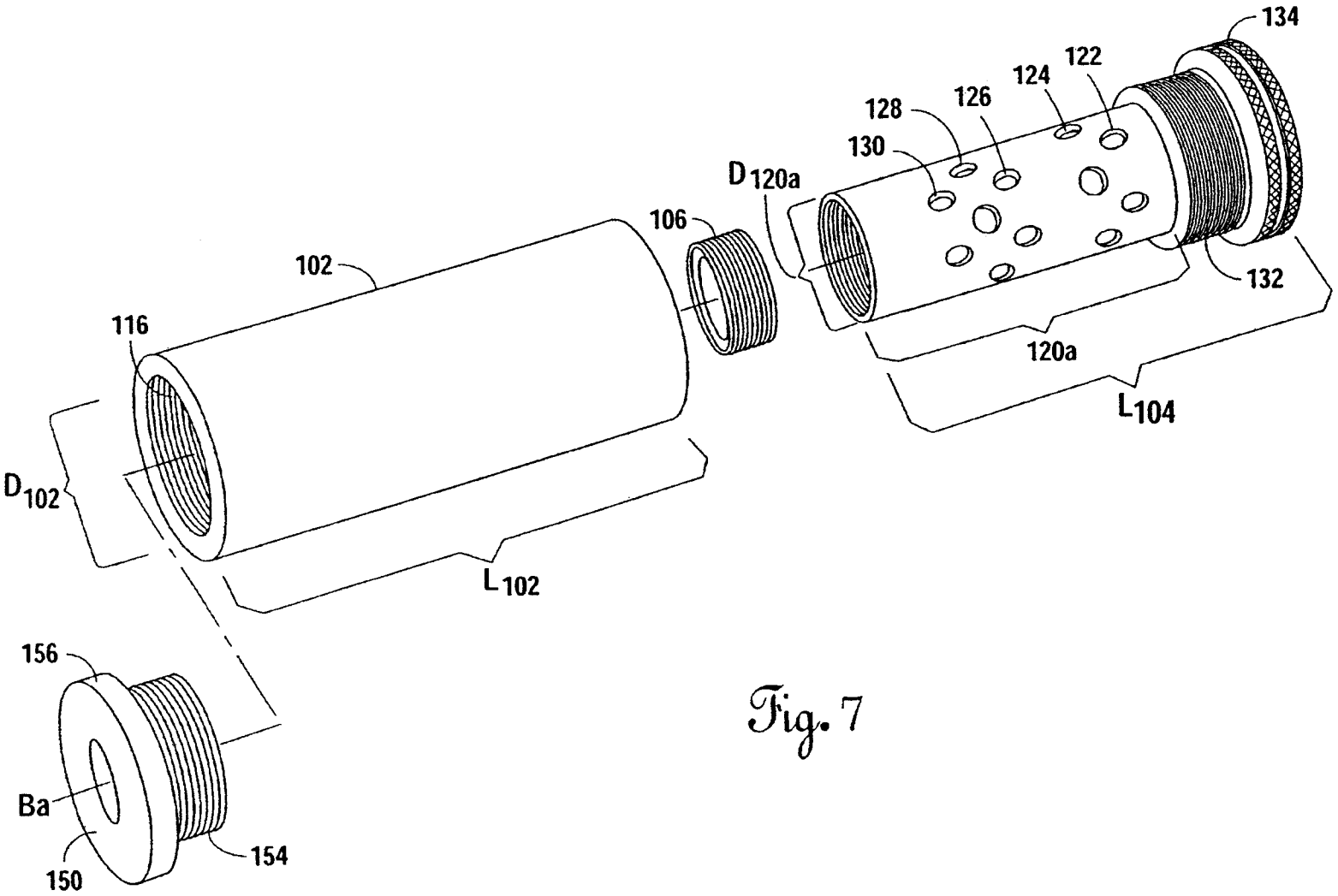
FIGS. 7-10 illustrate an alternate preferred embodiment of Applicant's muzzle brake/stabilizer, in FIG. 8 showing an embodiment without an end plug.
Figure 8:
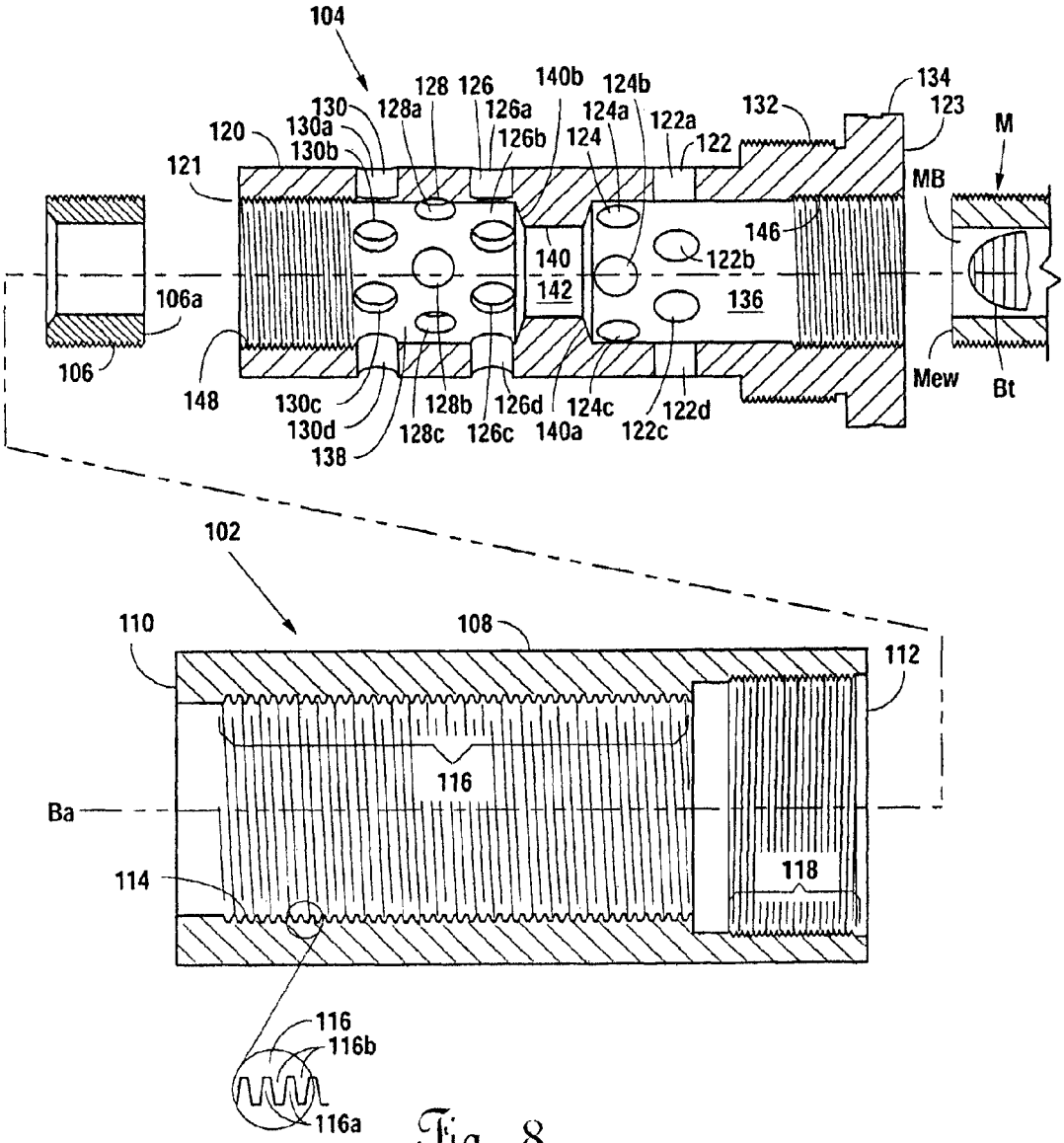
Figure 10:
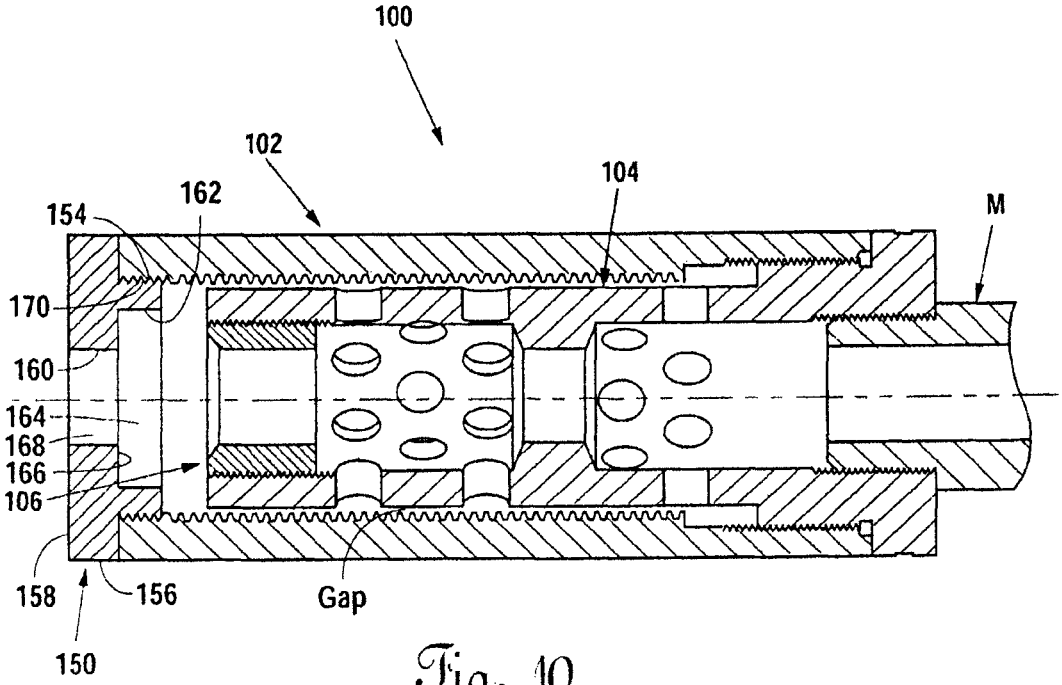

FIGS. 7, 9, and 10 illustrate a version of the alternate preferred embodiment of FIGS. 7-10, which includes an end plug 150 designed to threadably engage the removed end of outer member 102 as illustrated. Both end plug 150 and chamber plug 106 along with walls 140*a* have the effect of reducing recoil. End plug 150 is seen to be generally cylindrical and made of steel, aluminum or other suitable material, and has outer walls 152, which are typically cylindrical. Outer walls 152 may include a step-down portion 154, which is threaded in a knurled section 156. End walls 158 define a plane generally perpendicular to the bore axis Ba. Inner walls 160 are cylindrical and include third chamber walls 162. Third chamber walls 162 and third chamber end walls 166 define a third chamber 164 into which the annulus marked Gap is in communication with and, therefore will receive gases that are forced into the annulus through the multiplicity of holes in the first and second chambers. Further third chamber will receive gases just ahead of and gases behind the bullet as it passes through chamber plug 106, which gases have not been spent or exited through the multiplicity of holes of the first two chambers. Inner walls 106 also define bore opening 168 which is dimensioned to receive the bullet passing therethrough. A threaded section 170 on the inner walls of the removed end of outer member 102 are adapted to threadably engage step-down threaded section 154, so the end plug is snugly received within the outer member.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The above-described embodiments are intended to be examples only. Alterations, modifications and variations can be effected to the particular embodiments by those of skill in the art without departing from the scope, which is defined solely by the claims appended hereto.

The invention claimed is:

1. A muzzle brake and stabilizing device for a firearm having a barrel, the barrel having a barrel axis, a muzzle, and a breech end, the muzzle brake for engagement to the muzzle, the muzzle brake comprising:

a) walls defining a first chamber adjacent the muzzle end of the barrel, the first chamber having a substantially closed end wall with a bore opening and multiple side wall through openings;

b) walls defining a second chamber immediately following the first chamber, the second chamber having a substantially closed end wall with a bore opening and multiple side wall through openings;

c) walls defining a third chamber immediately following the second chamber, the third chamber with a substantially open end and having side walls;

d) walls defining an intermediate chamber, adapted to receive gases passing through the side wall through openings of the first and second chambers, the intermediate chamber with closed side walls and a substantially closed end wall with a bore opening;

e) walls defining a fourth chamber, proximate the end wall of the intermediate chamber, the fourth chamber having a substantially open end; and wherein the walls defining first and second chambers extend partly into the intermediate chamber, and the open end of the third chamber terminates short of the closed end wall of the intermediate chamber;

wherein the intermediate chamber includes an annulus portion and an end portion, and wherein the multiple sidewall openings of the walls defining the first and second chambers are in gaseous communication with the walls defining the intermediate chamber;

wherein the chambers are axially aligned with one another and further including walls adapted to engage the muzzle so as to place the axis of the chambers along the barrel axis.

2. The muzzle brake and stabilizing device of claim 1, wherein the multiple through openings of the first and second chambers open into the annulus portion of the intermediate chamber.

3. The muzzle brake and stabilizing device of claim 1, wherein the third chamber has multiple through openings.

4. The muzzle brake and stabilizing device of claim 3, wherein the multiple through openings of the third chamber are countersunk.

5. The muzzle brake and stabilizing device of claim 1, wherein the intermediate chamber end wall includes closed ended openings.

6. The muzzle brake and stabilizing device of claim 1, wherein the multiple through openings of the first chamber are radially arranged and number in the range of 4 to 10.

7. The muzzle brake and stabilizing device of claim 1, wherein the multiple through openings of the third chamber may be round or oval and number 2 to 4 disposed radially and equiangularly spaced.

8. The muzzle brake and stabilizing device of claim 1, wherein the side walls of the third and fourth chambers are cone shaped.

9. The muzzle brake and stabilizing device of claim 1, wherein the third chamber includes multiple rows of multiple through openings.

10. The muzzle brake and stabilizing device of claim 9, wherein the holes in adjacent rows are off-set, the off-set reflecting a rifle axis of the bore.

11. The muzzle brake and stabilizing device of claim 9, wherein the rows are cut into the sidewalls and the sidewalls are conical.

12. A muzzle brake and stabilizing device for a firearm having a barrel, the barrel having a barrel axis, a muzzle, and a breech end, the muzzle brake for engagement to the muzzle, the muzzle brake comprising:

a) walls defining a first chamber adjacent the muzzle end of the barrel, the first chamber having a substantially closed end wall with a bore opening and multiple side wall through openings;

b) walls defining a second chamber proximate the first chamber, the second chamber having a substantially closed end wall with a bore opening and multiple side wall through openings;

c) walls defining a third chamber proximate the second chamber, the third chamber with a substantially open end and having side walls;

d) walls defining an intermediate chamber, adapted to receive gases passing through the side wall through openings of the first and second chambers, the intermediate chamber with closed side walls and a substantially closed end wall with a bore opening;

e) walls defining a fourth chamber, proximate the end wall of the intermediate chamber, the fourth chamber having a substantially open end;

wherein the chambers are axially aligned with one another and further including walls adapted to engage the muzzle so as to place the axis of the chambers along the barrel axis;

wherein the intermediate chamber includes an annulus portion and an end portion;

wherein the multiple through openings of the first and second chambers open into the annulus portion of the intermediate chamber;

wherein the third chamber has multiple through openings;

wherein the intermediate chamber end wall includes closed ended openings;

wherein the side walls of the third and fourth chambers are cone shaped; and wherein the third chamber includes multiple rows of multiple through openings.

13. A muzzle brake and stabilizing device for a firearm having a barrel, the barrel having a barrel axis, a muzzle, and a breech end, the muzzle brake for engagement to the muzzle, the muzzle brake comprising:

walls defining a first chamber, adjacent the muzzle end of the barrel, the first chamber having multiple through openings and an axial bore in an end wall thereof;

walls defining a second chamber, directly adjacent and down axis from the first chamber, the second chamber including multiple through openings and an axial bore in an end wall thereof; and walls defining an intermediate chamber, the intermediate chamber having an end wall with an axial bore therethrough, wherein the intermediate chamber includes an annulus portion and an end portion;

wherein the through openings in the walls defining the first chamber and the second chamber are configured to open into the annulus portion of the intermediate chamber.

14. The muzzle brake and stabilizing device of claim 13, including walls defining a third chamber proximate the second chamber, the third chamber with a substantially open end and having side walls; and walls defining a fourth chamber, proximate the end wall of the intermediate chamber, the fourth chamber having a substantially open end; wherein the chambers are axially aligned with one another and further including walls adapted to engage the muzzle so as to place the axis of the chambers along the barrel axis.

15. The muzzle brake and stabilizing device of claim 13, wherein at least some of the through openings are countersunk.

16. The muzzle brake and stabilizing device of claim 13, wherein the intermediate chamber end wall includes closed ended openings.

17. The muzzle brake and stabilizing device of claim 13, wherein the first and second chamber through openings are comprised of multiple radial arranged rows.

18. The muzzle brake and stabilizing device of claim 17, wherein the holes in adjacent rows are off-set, the off-set reflecting a rifle axis of the bore.

19. The muzzle brake and stabilizing device of claim 18, wherein the rows are cut into the sidewalls and the sidewalls are conical.

* * * * *